US010066620B2

(12) United States Patent
Watanabe

(10) Patent No.: US 10,066,620 B2
(45) Date of Patent: Sep. 4, 2018

(54) INTERNAL GEAR PUMP

(71) Applicant: TOYOOKI KOGYO CO., LTD., Okazaki-shi, Aichi (JP)

(72) Inventor: Noritaka Watanabe, Okazaki (JP)

(73) Assignee: TOYOOKI KOGYO CO., LTD., Okazaki-Shi, Aich (JP)

( * ) Notice: Subject to any disclaimer, the term of this patent is extended or adjusted under 35 U.S.C. 154(b) by 0 days.

(21) Appl. No.: 15/505,166

(22) PCT Filed: Oct. 9, 2014

(86) PCT No.: PCT/JP2014/077073
§ 371 (c)(1),
(2) Date: Feb. 20, 2017

(87) PCT Pub. No.: WO2016/056103
PCT Pub. Date: Apr. 14, 2016

(65) Prior Publication Data

US 2017/0276131 A1 Sep. 28, 2017

(51) Int. Cl.
*F01C 21/10* (2006.01)
*F03C 2/00* (2006.01)
(Continued)

(52) U.S. Cl.
CPC ..... *F04C 2/084* (2013.01); *F04C 2/10* (2013.01); *F04C 2/102* (2013.01); *F01C 1/103* (2013.01);
(Continued)

(58) Field of Classification Search
CPC .. F04C 2/084; F04C 2/10; F04C 2/102; F04C 18/084; F04C 2250/20; F04C 2240/20; F01C 1/103
(Continued)

(56) References Cited

U.S. PATENT DOCUMENTS 1,863,335 A * 6/1932 Hill ..... F04C 2/102 418/171
2,091,317 A * 8/1937 Hill ..... F04C 2/084 418/150
(Continued)

FOREIGN PATENT DOCUMENTS

EP 3205881 8/2017
JP 10205458 8/1998
(Continued)

OTHER PUBLICATIONS

International Preliminary Report on Patentability from corresponding PCT Appln. No. PCT/JP2014/077073 dated Apr. 11, 2017. English translation attached.
(Continued)

*Primary Examiner* — Theresa Trieu
(74) *Attorney, Agent, or Firm* — Grossman, Tucker, Perreault & Pfleger, PLLC

(57) ABSTRACT

This internal gear pump accommodates: a ring-shaped internally toothed gear provided with internal teeth, and an externally toothed gear provided with external teeth which internally mesh with the internal teeth of the internally toothed gear, said externally toothed gear being eccentrically disposed inside the internally toothed gear. The number of internal teeth is one greater than the number of external teeth. In any one of the external teeth and the internal teeth, a tooth tip section and a meshing section are formed by a curve having one continuous curvature. The curve is formed by an equation with which the maximum curvature is at the apex of the tooth tip, and the curvature gradually reduces towards the tooth bottom section.

1 Claim, 5 Drawing Sheets

(51) Int. Cl.

| | |
|---|---|
| ***F03C 4/00*** | (2006.01) |
| ***F04C 2/00*** | (2006.01) |
| ***F04C 2/08*** | (2006.01) |
| ***F04C 2/10*** | (2006.01) |
| *F01C 1/10* | (2006.01) |

(52) U.S. Cl.
CPC ..... *F04C 2240/20* (2013.01); *F04C 2250/20* (2013.01)

(58) Field of Classification Search
USPC ..... 418/150, 166, 171
See application file for complete search history.

(56) References Cited

U.S. PATENT DOCUMENTS

| | | | | |
|---|---|---|---|---|
| 2,960,884 | A * | 11/1960 | Hill | F16H 55/08 74/462 |
| 3,709,055 | A * | 1/1973 | Grove | F04C 2/084 418/206.5 |
| 5,226,798 | A * | 7/1993 | Eisenmann | F04C 2/084 418/150 |
| 6,077,059 | A | 6/2000 | Hosono | |
| 2004/0009085 | A1 | 1/2004 | Lamparski et al. | |
| 2006/0171834 | A1 | 8/2006 | Ogata et al. | |
| 2013/0112028 | A1 | 5/2013 | Fujiki et al. | |

FOREIGN PATENT DOCUMENTS

| | | |
|---|---|---|
| JP | 2003-254409 | 9/2003 |
| JP | 2004-197670 | 7/2004 |
| JP | 2005-036735 | 2/2005 |
| JP | 2013-100762 | 5/2013 |
| JP | 2013-151899 | 8/2013 |

OTHER PUBLICATIONS

International Search Report from corresponding PCT Appln. No. PCT/JP2014/077073 dated Dec. 16, 2014. English translation attached.

Extended Search Report from related EPO Appln. No. 14903766.5, dated Mar. 6, 2018.

* cited by examiner

INTERNAL GEAR PUMP

TECHNICAL FIELD

The present invention relates to an internal gear pump that eccentrically accommodates an externally toothed gear inside an internally toothed gear so that internal teeth of the internally toothed gear internally mesh with external teeth of the externally toothed gear. In the internal gear pump, the number of the internal teeth is one greater than the number of the external teeth.

BACKGROUND ART

This type of internal gear pump rotatably accommodates a ring-shaped internally toothed gear provided with internal teeth in a housing hole of a pump housing, and eccentrically accommodates inside the internally toothed gear an externally toothed gear provided with external teeth which internally mesh with the internal teeth of the internally toothed gear. The internally toothed gear is rotated by a rotational drive of the externally toothed gear. A liquid is sucked from a suction port, and is discharged from a discharge port through a maximum volume space defined by the external teeth and the internal teeth. In the external teeth of the externally toothed gears, a tooth bottom section is formed by a hypocycloid curve, a tooth tip section is formed by an epicycloid curve, and a meshing section between the tooth tip section and the tooth bottom section is formed by an involute curve. The internal tooth of the internally toothed gear is formed by an envelope of a tooth profile curve of the corresponding external tooth. Since the involute curve is not related to eccentricity between the externally toothed gear and the internally toothed gear, the eccentricity can be freely set. Thus, the eccentricity can be increased to achieve a large discharge amount. In addition, a clearance between the external teeth and the internal teeth can be minimized at a maximum volume space side and at a deepest meshing section side where the external tooth most deeply meshes with the internal tooth. Also, the clearance between the external tooth and the internal tooth can be increased at a suction port side and a discharge port side between the maximum volume space and the deepest meshing section. A contact between the external teeth and the internal teeth over the entire circumference is avoided to improve mechanical efficiency.

PRIOR ART DOCUMENTS

Patent Documents

Patent Document 1: Japanese Unexamined Patent Application Publication No. 2005-36735

SUMMARY OF THE INVENTION

Problems to be Solved by the Invention

In the conventional internal gear pump, however, since the external tooth is formed by a hypocycloid curve at the tooth bottom section, by a epicycloid curve at the tooth tip section, and by a involute curve at the tooth tip section, the internal tooth meshing with the external tooth has to mesh with three different curves and move between discontinuous curves. In this case, the meshing between the internal tooth and the external tooth is disturbed due to fluctuation of a load, movement caused by a clearance between the internally toothed gear and the housing, etc. Due to this, noise is easily generated.

In an internal gear pump, it is desirable to be able to reduce generation of noise without impairing an advantage of improving mechanical efficiency by avoiding a contact between external teeth and internal teeth over the entire circumference.

Means for Solving the Problems

The present invention relates to an internal gear pump that accommodates: a ring-shaped internally toothed gear provided with internal teeth, and an externally toothed gear provided with external teeth which internally mesh with the internal teeth of the internally toothed gear. The externally toothed gear is eccentrically disposed inside the internally toothed gear. The number of internal teeth is one greater than the number of external teeth. In any one of the external teeth and the internal teeth, a tooth tip section and a meshing section are formed by a curve having one continuous curvature. The curve is formed by Equations (1) to (5) below with which a maximum curvature is at an apex of a tooth tip, and the curvature gradually reduces towards a tooth bottom.

$$r=ro-dr\cdot\cos\theta, \quad \text{Equation (1):}$$

$$Px=(ro-dr)+\tfrac{1}{4}\,dr\,\{1-\cos(2\theta)\}, \quad \text{Equation (2):}$$

$$Py=\tfrac{1}{4}\,dr\,\{-2\theta+\sin(2\theta)\}, \quad \text{Equation (3):}$$

$$Qx=Px-r\cdot\cos\theta, \text{ and} \quad \text{Equation (4):}$$

$$Qy=Py+r\cdot\sin\theta, \quad \text{Equation (5):}$$

where r is a radius of a curve, ro is a reference diameter, dr is a variation,

θ is a parameter,

Px is an X coordinate of a trajectory center,

Py is a Y coordinate of the trajectory center,

Qx is an X coordinate of a point on a curve generated by the trajectory center (Px, Py), and Qy is a Y coordinate of the point on the curve generated by the trajectory center (Px, Py).

EFFECTS OF THE INVENTION

In the present invention, in any one of the external teeth and the internal teeth, the tooth tip section and the meshing section are formed by a curve having one continuous curvature. In this curve, the maximum curvature is at the apex of the tooth tip, and the curvature gradually reduces towards the tooth bottom. For this reason, an envelope curve created by a curve forming the tooth tip section and the meshing section is a crossed curved section between the tooth tip section and the meshing section, so that the contact by the external teeth and the internal teeth over the entire circumference can be avoided. An advantage of improving mechanical efficiency is not impaired. Since the tooth tip section and the meshing section are formed by the curve having one continuous curvature in which the maximum curvature is at the apex of the tooth tip and the curvature gradually reduces towards the tooth bottom, discontinuous fluctuation of a meshing speed from the meshing section to the tooth tip section can be suppressed. Thereby, even if meshing between the internal teeth and the external teeth is disturbed due to fluctuation of the load or movement caused by the clearance between the internally toothed gear and the housing, the meshing between the internal teeth and the external teeth remains smooth, and generation of noise can be reduced.

EXPLANATION OF REFERENCE NUMERALS

1: internally toothed gear, 1A: internal tooth, 3: externally toothed gear, 3A: external tooth, 7A, 8A: tooth tip section, 7B, 8C: meshing section, L: curve

MODE FOR CARRYING OUT THE INVENTION

Hereinafter, an embodiment of the present invention will be described with reference to the drawings.

Figure 1:
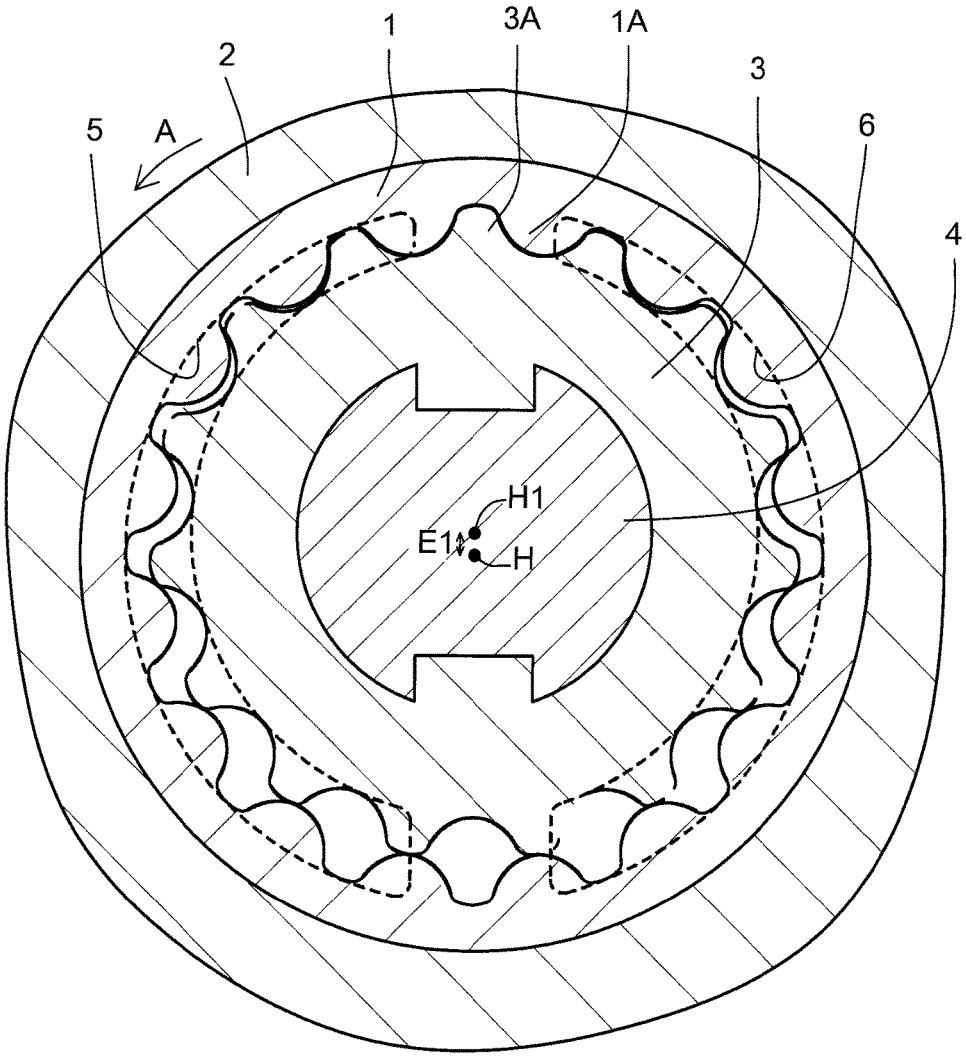
FIG. 1 is a sectional view of an internal gear pump showing one embodiment of the present invention.

In FIG. 1, a ring-shaped internally toothed gear 1 has sixteen internal teeth 1A and is accommodated in a housing 2 so as to be rotatable about a rotation center H. An externally toothed gear 3 has fifteen external teeth 3A that internally mesh with the internal teeth 1A and is accommodated in the internally toothed gear 1 so as to be rotatable about a rotation center H1 eccentric to the rotation center H. An eccentricity E1 between the internally toothed gear 1 and the externally toothed gear 3 is a dimension (distance) between the rotation center H of the internally toothed gear 1 and the rotation center H1 of the externally toothed gear 3. A drive shaft 4 rotationally drives the externally toothed gear 3 and engages with the externally toothed gear 3. A suction port 5 for sucking oil and a discharge port 6 for discharging oil are formed in the housing 2 so as to be provided at positions symmetrical to each other with respect to a straight line passing the rotation centers H and H1.

Figure 2:
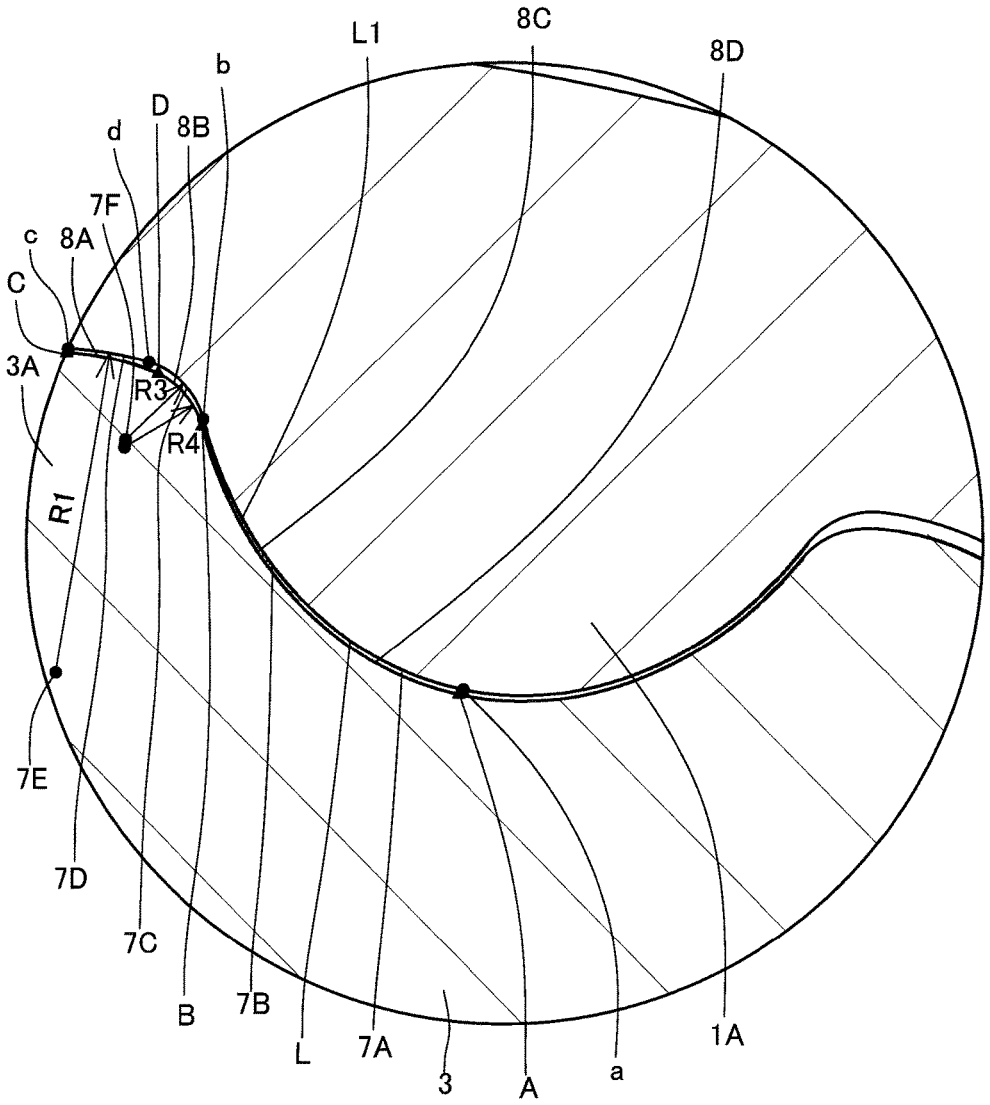
FIG. 2 is an enlarged view of a main part of FIG. 1.

FIG. 2 shows details of tooth profiles of the internal tooth 1A of the internally toothed gear 1 and the external tooth 3A of the externally toothed gear 3.

The internal tooth 1A comprises a tooth tip section 7A, a meshing section 7B, a connecting section 7C, and a tooth bottom section 7D, from a tooth tip toward a tooth bottom, from which a left half from an apex a of the tooth tip is formed. A right half from the apex a of the tooth tip is formed symmetrical to the left half with respect to a straight line passing the center H of the internally toothed gear 1 and the apex a. The tooth tip section 7A and the meshing section 7B are formed by a curve L in which a maximum curvature is at the apex a and the curvature gradually reduces towards the tooth bottom. Specifically, the tooth tip section 7A and the meshing section 7B are formed by a curve that connects between points a and b of the curve L. The curve L is obtained by Equations (1) to (5) below.

$$r=ro-dr\cdot\cos\theta, \quad \text{Equation (1):}$$

$$Px=(ro-dr)+\tfrac{1}{4}\,dr\,\{1-\cos(2\theta)\}, \quad \text{Equation (2):}$$

$$Py=\tfrac{1}{4}\,dr\,\{-2\theta+\sin(2\theta)\}, \quad \text{Equation (3):}$$

$$Qx=Px-r\cdot\cos\theta, \text{ and} \quad \text{Equation (4):}$$

$$Qy=Py+r\cdot\sin\theta, \quad \text{Equation (5):}$$

where r is a radius of a curve, ro is a reference diameter, dr is a variation,

θ is a parameter,

Px is an X coordinate of a trajectory center,

Py is a Y coordinate of the trajectory center,

Qx is an X coordinate of a point on a curve generated by the trajectory center (Px, Py), and Qy is a Y coordinate of the point on the curve generated by the trajectory center (Px, Py).

Figure 3:
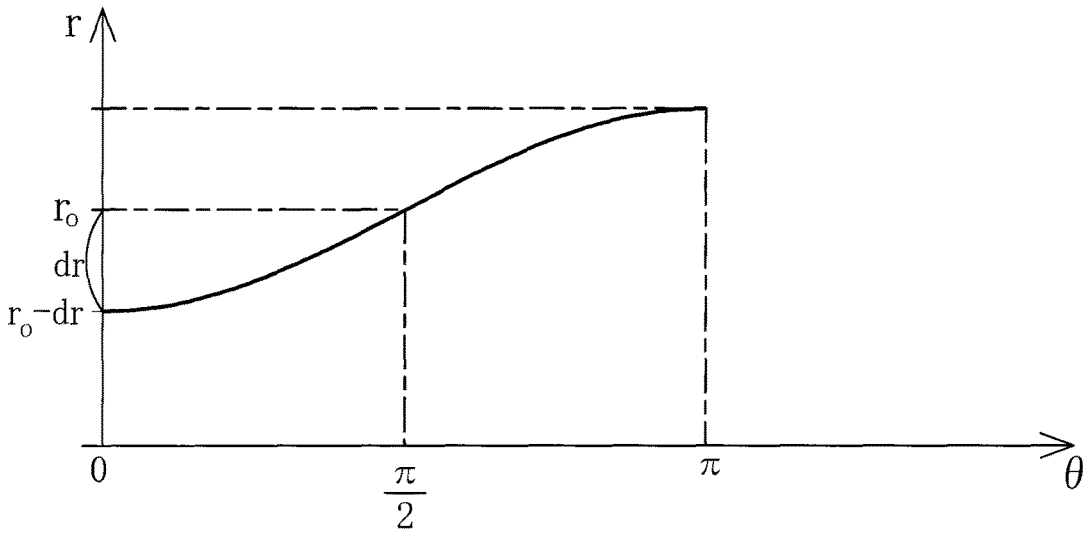
FIG. 3 is a schematic diagram of a tooth profile according to Equation 1.

FIG. 3 shows a schematic diagram of a tooth profile according to Equation 1. In FIG. 3, a vertical axis represents the radius r of the curve L, and a horizontal axis represents the parameter θ. FIG. 3 shows that r changes from ro−dr to ro as θ changes from 0 to π/2.

Figure 4:
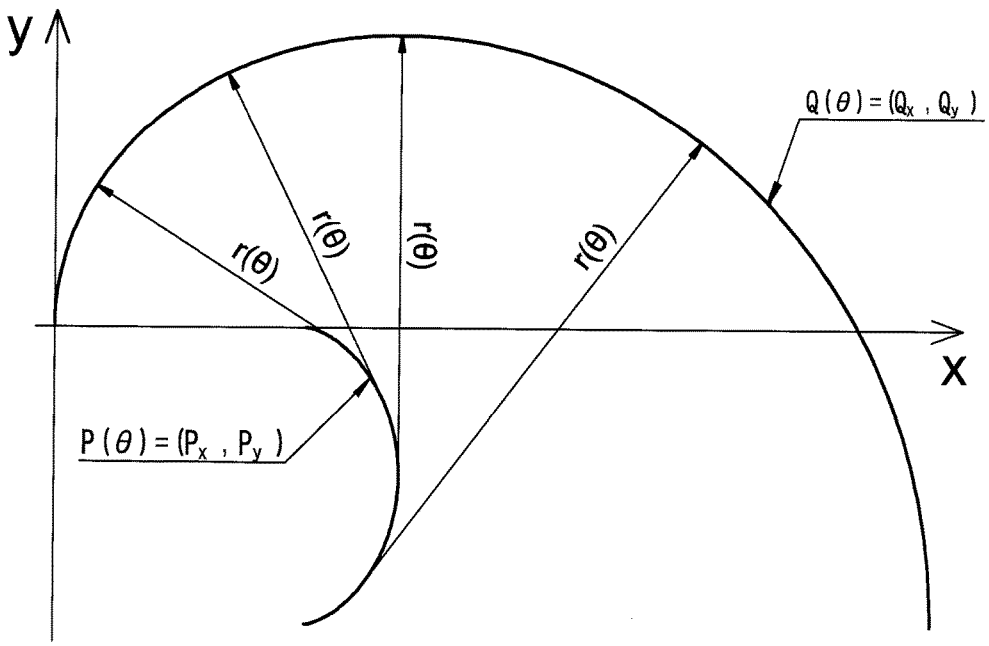
FIG. 4 is a schematic view of a tooth profile according to Equations 2 to 5.

FIG. 4 shows a schematic diagram of tooth profiles according to Equations 2 to 5. FIG. 4 illustrates that X, Y coordinates of a trajectory center P having the radius r forming the curve L (see also FIG. 2) and X, Y coordinates of a point Q on the curve L generated by the trajectory center P change in accordance with the parameter θ.

As shown in FIG. 2, the tooth bottom section 7D forms an arc having a center 7E and a radius R1, and is formed by an arc connecting points c and d of the arc. The arc with the radius R1 is formed by an arc slightly larger than an envelope curve created by a tooth tip section 8A of the externally toothed gear 3A to be described later. The center 7E is located on a line passing the rotation center H of the internally toothed gear 1 and a circumferential center of the tooth bottom section 7B. The connecting section 7C is formed by an arc having a center 7F and a radius R3 that is smaller than the radius R1. Specifically, an arc connecting the points b and d of the arc is the connecting section 7C.

The external tooth 3A comprises the tooth tip section 8A, a connecting section 8B, a meshing section 8C, and a tooth bottom section 8D. The tooth tip section 8A, the meshing section 8C, and the tooth bottom section 8D are formed by an envelope curve L1 created by the curve L forming the tooth tip section 7A and the meshing section 7B of the internal tooth 1A. The tooth tip section 8A is formed by a portion between points C and D in the envelope curve L1. The meshing section 8C and the tooth bottom section 8D are formed by a portion between points A and B in the envelope curve L1. The connecting section 8B is a rounded portion that connects between the tooth tip section 8A and the meshing section 8C and is formed by an arc having a radius R4. Specifically, the connecting section 8B is formed by a portion between points B and D of the arc having the radius R4.

Figure 5:
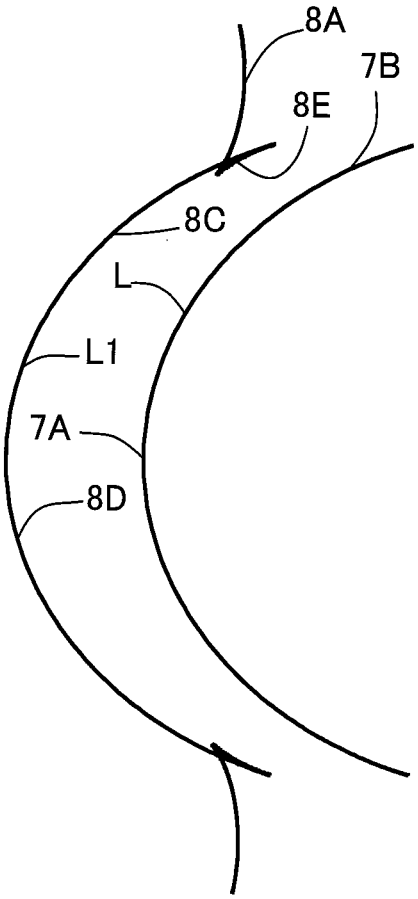
FIG. 5 is a schematic diagram of an envelope curve L1 created by a curve L that forms a tooth tip section and a meshing section according to one embodiment.

FIG. 5 shows a schematic diagram of the envelope curve L1 created by the curve L forming the tooth tip section 7A and the meshing section 7B of the internal tooth 1A.

The envelope curve L1 is a crossed curved section 8E between the tooth tip section 8A and the meshing section 8C, and this portion is not created as a tooth profile. The connecting section 8B is formed by rounding the curved section 8E.

Now, operation of the above configuration will be described.

When the externally toothed gear 3 is rotationally driven in a rotation direction A by a driving shaft 4, the internally toothed gear 1 that internally meshes with the externally toothed gear 3 is rotationally driven, and oil sucked from the suction port 5 is discharged from the discharge port 6.

In the internal tooth 1A, the tooth tip section 7A and the meshing section 7B are formed by the curve L having one continuous curvature, and the curve L is formed such that the maximum curvature is at the apex a of the tooth tip and the curvature gradually reduces towards the tooth bottom. Therefore, the envelope curve L1 that is created by the curve L forming the tooth tip section 7A and the meshing section 7B of the internal tooth 1A and that forms the tooth tip section 8A, the meshing section 8C, and the tooth bottom section 8D of the external tooth 3A is the crossed curved section 8E between the tooth tip section 8A and the meshing section 8C. Thus, the contact between the external tooth 3A and the internal tooth 1A over the entire circumference can be avoided. The advantage of improving mechanical efficiency is not impaired. Since the tooth tip section 7A and the meshing section 7B are formed by the curve L having one continuous curvature, in which the maximum curvature is at the apex a of the tooth tip and the curvature gradually reducing towards the tooth bottom, discontinuous fluctuation of a meshing speed from the meshing section 7B to the tooth tip section 7A can be suppressed. Therefore, even if the meshing between the internal teeth 1A and the external teeth 3A is disturbed due to the fluctuation of the load or the movement caused by the clearance between the internally toothed gear 1A and the housing 2, the meshing between the internal tooth 1A and the external tooth 3A smoothly shifts, and generation of noise can be reduced.

In one embodiment, the tooth tip section 7A and the meshing section 7B of the internal tooth 1A are formed by the curve L in which the maximum curvature is at the apex a of the tooth tip and the curvature gradually reduces towards the tooth bottom, and the tooth tip section 8A, the meshing section 8C, and the tooth bottom section 8D of the external tooth 3A are formed by the envelope curve L1 created by the curve L. To the contrary, the tooth tip section and the meshing section of the external tooth 3A may be formed by a curve in which the maximum curvature is at an apex of the tooth tip and a curvature gradually reduces towards the tooth bottom, and each of the tooth tip section, the meshing section, and the tooth bottom section of the internal tooth 1A may be formed by an envelope curve created by the curve forming the tooth tip section and the meshing section of the external tooth 3A.

The invention claimed is:

1. An internal gear pump that accommodates: a ring-shaped internally toothed gear provided with internal teeth, and an externally toothed gear provided with external teeth which internally mesh with the internal teeth of the internally toothed gear, the externally toothed gear being eccentrically disposed inside the internally toothed gear, the number of internal teeth being one greater than the number of external teeth, wherein, in any one of the external teeth and the internal teeth, a tooth tip section and a meshing section are formed by a curve having one continuous curvature, the curve being formed by Equations (1) to (5) below with which a maximum curvature is at an apex of a tooth tip, and the curvature gradually reduces towards a tooth bottom, $$r=ro-dr\cdot\cos\theta, \quad \text{Equation (1):}$$

$$Px=(ro-dr)+\tfrac{1}{4}\,dr\,\{1-\cos(2\theta)\}, \quad \text{Equation (2):}$$

$$Py=\tfrac{1}{4}\,dr\,\{-2\theta+\sin(2\theta)\}, \quad \text{Equation (3):}$$

$$Qx=Px-r\cdot\cos\theta, \text{ and} \quad \text{Equation (4):}$$

$$Qy=Py+r\cdot\sin\theta, \quad \text{Equation (5):}$$

where r is a radius of a curve, ro is a reference diameter, dr is a variation,

θ is a parameter,

Px is an X coordinate of a trajectory center,

Py is a Y coordinate of the trajectory center,

Qx is an X coordinate of a point on a curve generated by the trajectory center (Px, Py), and Qy is a Y coordinate of the point on the curve generated by the trajectory center (Px, Py).

* * * * *